United States Patent [19]

Beaver

[11] 4,135,726

[45] Jan. 23, 1979

[54] SKATEBOARD

[76] Inventor: Bryan Beaver, 317 Lorenzi St., Las Vegas, Nev. 89107

[21] Appl. No.: 828,909

[22] Filed: Aug. 29, 1977

[51] Int. Cl.[2] ..... B60D 3/00
[52] U.S. Cl. ..... 280/87.04 A; D34/15 AT
[58] Field of Search ..... 280/87.04 A, 87.04 R; 16/114 R; D34/15 AT

[56] References Cited

U.S. PATENT DOCUMENTS

| | | | |
|---|---|---|---|
| D. 214,252 | 5/1969 | Anderson | 280/87.04 A |
| 3,751,062 | 8/1973 | White | 280/87.04 A |

*Primary Examiner*—John A. Pekar
*Attorney, Agent, or Firm*—Jay M. Cantor

[57] ABSTRACT

A skateboard provided with any easily attachable and detachable hand rail which extends the full length of the skateboard platform and which can be grasped by a rider in standing position thereon.

12 Claims, 4 Drawing Figures

SKATEBOARD

The invention herein disclosed relates to an improvement in a conventional skateboard. As is know, a conventional skateboard is comprised of a narrow elongated platform base carrying on its underside a pair of skate wheels at each of its ends. The platform base is usually narrower than even a child's foot but it is wider than the distance between the wheels of a pair. When a rider stands on the platform in an upright or crouched position with a portion of his feet overhanging the sides thereof, he must continually shift his weight to one side or the other to maintain his balance as the skateboard moves along at various speeds.

It is difficult for a beginner to maintain his balance for long and as a result he falls off or upsets the board due to rapid shifting of weight to one side of the other. It is believed that it would be most helpful to a beginner to be able to grab or to hold on to a rail secured to the board while travelling along the ground. It could also be useful to experienced skateboard users in manuevering it to execute sharp turns.

My invention therefore, is directed to a rail member which may be attached at its ends to the ends of the board and which overlies the longitudinal center of the platform. In order to easily mount or dismount the hand rail from the board, the rail is provided at each of its ends with a socket member, the openings of which face each other and which receive a respective end of the board. The rail member may be a tubular or flat member of plastic or aluminium bent into the form of an arc or it may be substantially U-shaped. The distance between the open ends of the socket members may be made somewhat smaller than the length of the skateboard. In this way, the sockets may first be pulled away from each other due to the inherent resiliency of the rail and then be allowed to snap back over the ends of the skate board. The rail may be held to the skateboard by any known means, such as a camming lock arrangement or by a set screw through a wall of the socket and abutting the platform. A tension spring tending to draw the sockets together may be additionally used to ensure that the socket members firmly engage the board during use in the event the locking means becomes loose It is therefore an object of this invention to provide a rail extending substantially between the ends of a skateboard and overlying the platform.

It is a further object of the invention to provide a rail overlying and extending substantially between the ends of a skateboard and which is detabhably secured to the platform thereof.

It is an additional object of the invention to detachably mount a rail on the platform of a skateboard in such a manner as to maintain it firmly thereon without excessive vibrations.

It is a still further object of the invention to provide a rail on the platform of a skateboard which extends substantially the full length thereof and which is of a height to be grasped by a rider standing on the platform.

The above and other objects will become apparent as the description of the invention proceeds with specific reference to the drawings in which:

FIG. 3 is an end view of a socket member at one end of the rail; and

Figure 5:
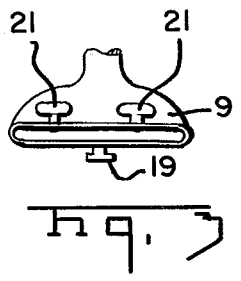
Figure 4:
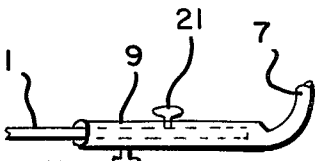
FIG. 4 is a side view of a socket mounted on one end of the skateboard.
Figure 2:
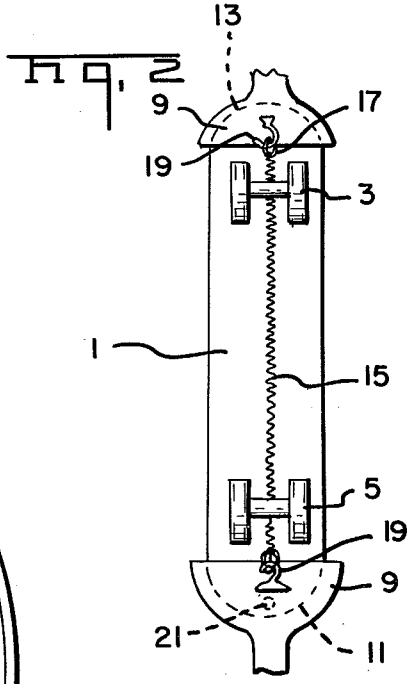
FIG. 2 is a plan view of the underside of the skateboard showing the socket portions of the rail mounted at the ends of the platform and a tension spring connected between them.
Figure 1:
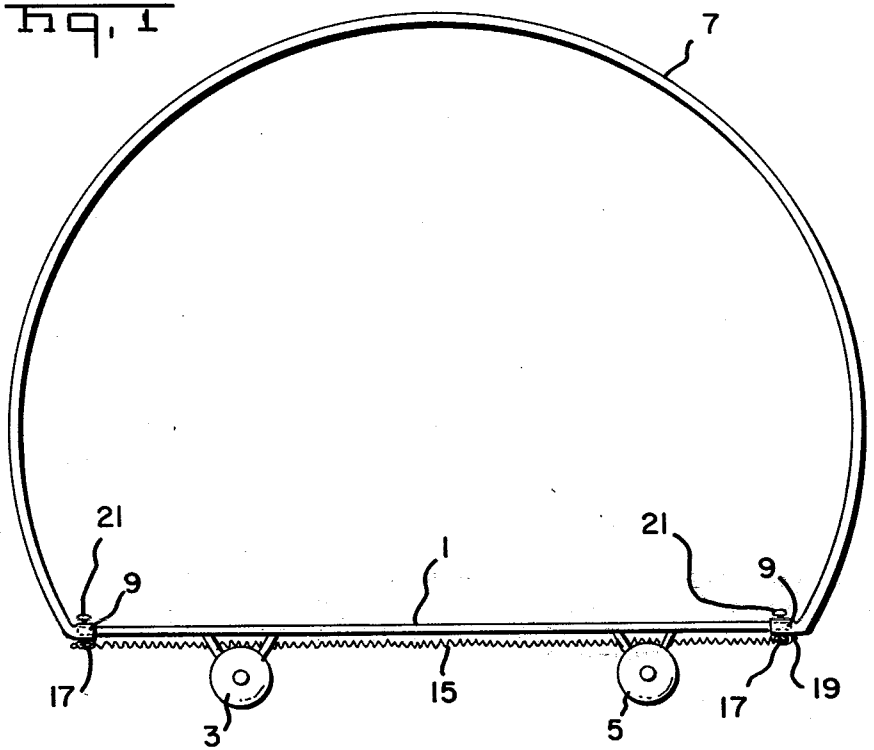
FIG. 1 is a side elevation of the skateboard with the rail attached.

Reference number 1 denotes the platform base of the skateboard which is of elongated form and which may be round, square or tapered at its ends. To the underside of the base is secured a pair of ball-bearing skate wheels 3 adjacent one end thereof and a second pair of ball-bearing skate wheels 5 adjacent its other end.

The platform carries a rail or handhold member 7 extending substantially centrally from adjacent one end thereof to adjacent the other end. The rail member may be arcuate or in the form of an inverted U and of rigid plastic or metal and of any desired cross-section such as circular, oval, rectangular etc. and either solid or of hollow tubular construction. While the rail member 7 may be permanently mounted on the platform it if preferred to make provisions for detachably mounting the rail member to the platform so that it may be sold as an accessory and mounted or dismounted from the skateboard at will. For this purpose the extreme ends of the rail member are each provided with a flat socket member 9 which is closed at the end secured to the rail member and which is open at its other end to respectively receive a marginal end portion of the platform. The socket members may be integrally formed with the rail member or they may be produced separately and secured in any suitable manner to the rail member.

In the relaxed state of the rail member 7 before being mounted onto the platform, the distance between the open ends of the sockets is somewhat less than the length of the platform. In mounting the rail member onto the platform, the distance between the open ends of the sockets can be increased by pulling them apart due to the inherent resiliency of the material of the rail member so that the sockets may snap over the platform ends 11, 13 when released. If desired, the shape of the socket openings may be made to closely conform to the shape of the platform ends, which latter may be arcuate as shown, square or tapered. The socket members are held against the ends of the platform not only by inherent resilience of the material of the rail member but by a tension spring 15 provided at its ends with a ring 17 which is looped over a hook member 19 projecting from the lower wall of each of the socket members. A pair of bolts or set screw 21 are threaded through the upper wall of each socket member to bear against the surface of the platform to firmly retain the rail on the skateboard and to provide for easy removal thereof when desired.

It is seen therefore, that I have provided a handhold or rail which may be easily attached to or detached from a skateboard and which is useful not only for beginners but also for more experienced users in maneuvering the skateboard. For example, in making sharp turns with both feet on the platform while the skateboard is moving, an experienced user may raise the wheels at one end of the skateboard from the ground by pulling upward on that end of the rail while shifting his weight to the other end of the board and thus guide the skateboard to execute sharp turns in either direction by pushing or pulling the rail laterally. For a beginner, the rail member or handhold is useful in helping him to maintain his balance on the skateboard especially when it is travelling down hill at a great speed.

Having thus described my invention with the particularities required by the statutes it is understood that obvious changes and modification may be made by persons skilled in the art without departing from the spirit, scope and intent of the invention as defined by the following claims.

What is claimed is:

1. A skateboard comprising an elongated platform for supporting a person thereon in a standing position, a pair of skate wheels secured to the underside of said platform adjacent each end thereof, a hand rail extending substantially between the ends of the skateboard and overlying the platform, means for removably securing the ends of the hand rail to the respective ends of the platform, said means for removably securing comprising a socket portion at each end of said hand rail for removably receiving the respective end of said platform and said socket portions being removably mounted on the end of the skateboard, and including means extending between the socket portions for biasing them against the ends of the platform.

2. A skateboard according to claim 1 wherein said means for biasing said sockets comprises a spring.

3. A skateboard according to claim 2 wherein the means for removably securing further includes means for locking the socket portions to the platform.

4. A skateboard according to claim 1 wherein the socket portions and hand rail are integrally connected.

5. A skateboard according to claim 4 wherein the hand rail is of acruate shape and of resilient material with the socket portions biased toward each other by the inherent resiliency of the material of the hand rail, the socket having opposed open ends which are normally spaced apart a distance less than the length of the platform before being assembled therewith.

6. A skateboard according to claim 5 including means extending between the socket portions for maintaining said socket portions against the ends of the platform.

7. A skateboard according to claim 6 wherein said means for maintaining includes a spring.

8. A skateboard according to claim 7 wherein the means for removably securing further includes means for locking the socket to the platform.

9. A removable attachment for a skateboard having an elongated platform supported on forward and rear wheels comprising, a rail provided at its ends with downwardly depending leg portions, said rail being of resilient material with its leg portions normally biased toward each other by the inherent resiliency of the material, socket members secured to the free ends of the leg portions with the open ends of the sockets in opposed relation, said socket portions being shaped to receive the respective ends of portions of the platform.

10. A removable attached according to claim 9 including attaching means on each socket member for anchoring one end of a tension spring extending between them when mounted on a respective end portion of the platform.

11. A removable attachment according to claim 10 further including a locking member extending through a wall of each socket member for securing it to the platform.

12. A removable attachment according to claim 9 further including a locking member extending through a wall of each socket member for securing it to the platform.

* * * * *